United States Patent [19]

Blackstone

[11] 4,416,792

[45] * Nov. 22, 1983

[54] IMINODIPROPIONATE CONTAINING DETERGENT COMPOSITIONS

[75] Inventor: Paul C. Blackstone, Collingswood, N.J.

[73] Assignee: Lever Brothers Company, New York, N.Y.

[ * ] Notice: The portion of the term of this patent subsequent to Mar. 1, 2000 has been disclaimed.

[21] Appl. No.: 419,357

[22] Filed: Sep. 17, 1982

Related U.S. Application Data

[63] Continuation of Ser. No. 320,390, Nov. 12, 1981, Pat. No. 4,375,422.

[51] Int. Cl.[3] ..... C11D 1/10; C11D 1/83; C11D 3/075; C11D 11/02

[52] U.S. Cl. ..... 252/110; 252/173; 252/174.21; 252/527; 252/546; 252/DIG. 14

[58] Field of Search ..... 562/568, 571; 252/117, 252/110, 174, 174.21, 527, 546, DIG. 1

[56] References Cited

U.S. PATENT DOCUMENTS

| | | | |
|---|---|---|---|
| 2,731,421 | 1/1956 | Stayner | 252/546 |
| 3,086,943 | 4/1963 | Lang | 252/546 |
| 3,151,084 | 9/1964 | Schiltz | 252/527 |
| 3,341,460 | 9/1967 | Wei | 252/546 |
| 3,355,390 | 11/1967 | Behrens | 252/527 |
| 3,430,641 | 3/1969 | Newman | 134/22 |
| 3,442,812 | 5/1969 | Barnhurst | 252/142 |
| 3,726,797 | 4/1973 | Sunby | 252/8.8 |
| 4,080,310 | 3/1978 | Ng | 252/544 |
| 4,140,650 | 2/1979 | Wilde | 252/135 |
| 4,264,479 | 4/1981 | Flanagan | 252/524 |

*Primary Examiner*—Dennis L. Albrecht
*Attorney, Agent, or Firm*—James J. Farrell

[57] ABSTRACT

This invention relates to a detergent composition and a method for substantially eliminating separation of nonionic from a detergent slurry. The composition consists essentially of: (a) about 10%-60% builder; (b) about 2%-25% nonionic surfactant; (c) 0% to about 30% other ingredients; (d) an effective amount to substantially prevent separation of the nonionic from the detergent composition of a surface active iminodipropionate of the general formula:

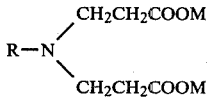

wherein R is an alkyl, hydroxyalkyl or oxyalkyl group containing from about 10 to about 18 carbon atoms and M is an alkali metal cation; and (e) the remainder water.

10 Claims, No Drawings

IMINODIPROPIONATE CONTAINING DETERGENT COMPOSITIONS

This is a continuation application of Ser. No. 320,390 filed Nov. 12, 1981 now U.S. Pat. No. 4,375,422.

This invention relates generally to detergent compositions. More particularly, it relates to surface active iminodipropionate-containing detergent compositions and methods of making same.

The processing of spray-dried detergent formulations containing high levels of nonionic surfactants of the ethoxylated type suffers from various problems. One of the problems is the separation of the active to the surface of the prepared slurries of nonionic-containing detergent mixtures unless strong agitation is maintained. The separation of the nonionic active is undesirable, not only from the slurry preparation point of view but also from the safety, environmental impact and cost aspects of subsequent processing steps. Thus, when a tower spray process is employed for drying the detergent slurry, separation of the nonionic from the detergent mixtures creates a potential hazard for fire or explosion due to the usually inflammable nature of the nonionics used in the detergent compositions. The separated nonionic slurry may also be an additional cause for unacceptable tower exhaust pluming. Further, the separation of the nonionic during the tower drying phase can enhance the loss of the nonionic by volatilization or combustion thereby resulting in an increased cost of production. In such cases, a higher level of the nonionic must be formulated to compensate for the loss of the nonionic during the tower drying phase.

It has been discovered that these and other problems are substantially obviated or minimized and a stable homogeneous mixture of a nonionic-containing detergent composition with little or no tendency toward separation of the nonionic is obtained if a sufficient amount of certain surface active iminodipropionates is added to the detergent slurry.

The use of alkyliminodipropionates in detergent formulations, e.g. as stain or spot removers or in shampoos, is disclosed by several publications (see U.S. Pat. Nos. 4,264,479; 4,207,198 and 4,080,310). The use of N-alkyl iminodiacetic acid and N-(hydroxyhydrocarbyl) iminodicarboxylic acid or their salts in detergent compositions is disclosed by U.S. Pat. Nos. 2,731,421 and 3,864,389, respectively. However, the use of surface active iminodipropionates to substantially prevent or to minimize the separation of the nonionics in a detergent slurry mixture is neither taught nor suggested by any of these patents.

It is, therefore, an object of the present invention to provide an iminodipropionate-containing detergent composition and methods wherein the separation of the nonionic from the detergent slurry is substantially prevented or minimized.

It is a further object of the present invention to provide a stable homogeneous slurry wherein a substantially higher level of nonionic surfactant may be used in the detergent formulation without the separation of the nonionic from the slurry mixture.

Other objects and advantages will appear as the description of the invention proceeds.

The attainment of these and other objects is accomplished by this invention which includes a detergent composition consisting essentially of, in percent by weight of the composition,: (a) about 10%–60% builder; (b) about 2%–25% nonionic surfactant; (c) 0% to about 30% other ingredients; (d) an effective amount to substantially prevent separation of the nonionic from the detergent composition of a surface active iminodipropionate of the general formula:

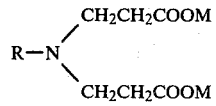

wherein R is an alkyl, hydroxyalkyl or alkoxyalkyl group containing from about 10 to about 18 carbon atoms and M is an alkali metal cation; and (e) the remainder water.

The builders that can be used are any of those that are compatible and suitable for the formulation of a detergent composition according to the teaching of the present invention. Some of the examples of such builders are alkali metal phosphates, carbonates, citrates, silicates, nitrilotriacetates, carboxymethyloxysuccinates, zeolites (alumino silicates) and the like. The amounts of the builders may range from about 10% to about 60% by weight of the composition.

Examples of nonionic surfactants that may be employed in the preparation of a detergent composition according to the teaching of the present invention are primary alcohol ethoxylates in which the hydrophobic unit contains from about 8 to about 20 carbon atoms and the number of moles of oxyethylene groups per mole of hydrophobic unit is from about 3 to about 20, (e.g. Shell Chemical's trademarked products Neodol 45-13, Neodol 45-11, Neodol 45-7, Neodol 23-6.5, Neodol 25-9, Neodol 25-3 and the like and Conoco's trademarked products Alfonic 1218-70 and Alfonic 1412-70 and the like), alkyl phenol ethoxylates, (e.g. Monstanto's trademarked products Sterox DJ, Sterox DF and Hart Chemical's Rexol 25/8 and Rexol 25J and the like), octylphenoxypolyethoxy ethanols, (e.g. Rohm & Haas' trademarked products Triton series), polyethylene glycol ethers of secondary alcohols (e.g. Union Carbide's trademarked products Tergitol series) and the like. A preferred group of these surfactants contains about 12 to 18 carbon atoms in the alkyl chain and about 60–70% of ethylene oxide expressed as a weight percent of the total molecule. The amounts of the nonionics may range up to about 25% by weight of the composition. Suitable surfactant materials are also disclosed in Schwartz & Perry: "Surface Active Agents & Detergents," Vol. II, 1958, and incorporated herein by reference.

Other ingredients which may be optionally employed are such components as soaps, coloring dyes, suds stabilizers (e.g. lauric isopropanolamide), organic solvents (e.g. dibutyl phthalate), fluorescent dyes, enzymes, perfumes, antiredeposition agents (e.g. carboxymethylcellulose), soil shield agents (e.g. hydropropyl methyl cellulose), bleaches, neutralized copolymers of ethylene and maleic anhydrides (e.g. EMA resins manufactured by the Monsanto Company), co-surfactants and the like. Co-surfactants may be selected from the group consisting of anionic, cationic, and zwitterionic surfactants and mixtures thereof. The bleaches may be chlorine or oxygen releasing types. The amounts of these adjuvants may range from 0 to 30% by weight of the composition. Some of the adjuvants may be incorporated during the slurry preparation and others, because of stability considerations, would be post added to the spray-dried product as well known to those skilled in the art.

As pointed out earlier herein, there is a considerable tendency of the nonionics to separate out from the detergent slurry particularly during the crutching process unless vigorous agitation is maintained. Surprisingly, it was found that the addition of low levels of surface active iminodipropionates in the slurry mixture substantially prevented or minimized the separation of nonionics and a stable homogeneous slurry was maintained without the need for vigorous agitation. The amount of the surface active iminodipropionate that is sufficient to produce a stable slurry is less than about 2% by weight of the detergent composition (finished basis). Generally, the amount required is about 0.1% to about 0.5%. in principle only an effective amount of the surface active iminodipropionate is needed whereby the nonionic surfactant is substantially prevented from separating out of the detergent slurry. It is postulated, without being bound to any theory, that the surprising effect of obtaining a stable homogeneous mixture with these low levels of iminodipropionates may be due to the formation of a readily dispersible, mixed micelle of the nonionic surfactant and the N-substituted iminodipropionate. The effective iminodipropionates may be represented by the following general formula:

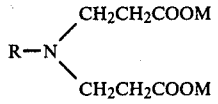

wherein R is an alkyl, hydroxyalkyl or alkoxyalkyl group containing from about 10 to about 18 carbon atoms and M is an alkali metal cation. Preferred groups are those in which R is an alkyl group containing 12 to 14 carbon atoms and most preferred are those compounds where R is a n-$C_{12}H_{25}$ or a n-$C_{14}H_{29}$ non-ether moiety.

The efficacy of different iminodipropionates was determined by the following test.

One kilogram batches (basis dried finished product) of a detergent were prepared using a propeller stirrer (3" diameter; 45° pitch) in a 1500 ml beaker on a Corning heating plate. The raw materials were admixed under constant agitation in the order shown in Example 1. The slurry moisture in Example I was about 36%. Although the order of addition of Example I is preferred, any order can be employed as long as nonionic is present in the slurry. The nonionic stock (Neodol 45-13) was dyed red (Calco Oil Red DM) to improve the contrast and facilitate observation. The temperature of the slurries ranged between 150°-190° F. Observations were made by 170° F. unless otherwise specified.

The finished batch containing the red-dyed nonionic was vigorously stirred to a homogeneous pink color. The propeller stirrer was removed; a glass thermometer was immersed in the slurry and the beaker was sealed with aluminum foil to prevent water evaporation.

The batch was periodically inspected for evidence of nonionic separation. Visual observations were made based on the rate of increase of the amount of nonionic on the surface of the undisturbed slurry. Observations were made at 170° F. during the first minute at fifteen second intervals and then every minute thereafter for about 20 minutes.

There are certain inherent drawbacks in the above method of evaluation for which allowances should be made when testing for the separation of the nonionic from the slurry.

Typically, a substantial film of slurry forms along the inner wall of the beaker as a result of the vigorous agitation to which the slurry must be subjected to achieve homogeneity. Subsequently, water which continuously condenses on the inner wall of the beaker, preferentially washes down the nonionic from the slurry film and concentrates around the edge of the slurry surface. The resulting nonionic ring should be disregarded because it is not representative of the conditions obtained during the actual manufacturing process.

Skinning (crust formation) at the surface of the slurry is another undesirable effect since it creates a physical barrier that restricts the separated nonionic from becoming evident at the surface. Skinning is postulated to occur as the water evaporating from the slurry surface condenses at the relatively cooler beaker wall and aluminum cover causing a redistribution of the surface moisture.

Table 1 lists the compounds which were evaluated by the above-decribed test for their efficacy for maintaining a homogeneous dispersion of the nonionic in the detergent slurry. In order to provide uniformity of testing, the concentration level of each compound evaluated was 0.1%.

TABLE 1

(1) n-$C_{12}H_{25}N(CH_2CH_2COONa)_2$
(2) n-$C_{14}H_{29}N(CH_2CH_2COONa)_2$
(3) branched $C_{10}H_{21}—O—(CH_2)_3N(CH_2CH_2COONa)_2$
(4) branched $C_{13}H_{27}—O—(CH_2)_3N(CH_2CH_2COONa)_2$
(5) Sodium salt of "alkyl iminodipropionic acid" sold under the tradename "Alkali Surfactant" by Tomah Products, Milton, Wisconsin.
(6) n-$C_{10}H_{21}—O—(CH_2)_3N(CH_2CH_2COONa)_2$
(7) n-$C_8H_{17}—O—(CH_2)_3N(CH_2CH_2COONa)_2$
(8) n-$C_6H_{13}—O—(CH_2)_3N(CH_2CH_2COONa)_2$
(9) n-$C_{10}H_{21}N(CH_2CH_2COONa)_2$
(10) $HN(CH_2CH_2COONa)_2$
(11) $CH_3N(CH_2CH_2COONa)_2$
(12) n-$C_6H_{13}N(CH_2CH_2COONa)_2$
(13) $CH_3—O—(CH_2)_3N(CH_2CH_2COONa)_2$
(14) LAS(Sodium salt of linear $C_{10}$–$C_{15}$ alkylbenzenesulfonic acids
(15) n-$C_{11}H_{23}CON(CH_2CH_2OH)_2$ (lauric diethanolamide)
(16) $CH_3(CH_2)_8CH{=}CH_2—CH(COONa)—CH_2(COONa)$
(17) n-$C_{10}H_{21}NHCH_2CH_2COONa$
(18) n-$C_{12}H_{25}NHCH_2CH_2COONa$
(19) n-$C_{14}H_{29}NHCH_2CH_2COONa$
(20) n-$C_6H_{13}—O—(CH_2)_3NHCH_2CH_2COONa$
(21) n-$C_8H_{17}—O—(CH_2)_3NHCH_2CH_2COONa$
(22) n-$C_{10}H_{21}—O—(CH_2)_3NHCH_2CH_2COONa$ Compounds #1 through #6 were most effective; compounds #1 and #2 demonstrating the most activity. Compounds #7, #8 and #9 showed only marginal activity while the remaining compounds, #10 through #22 showed no activity or improvement over the control. Compounds #7, #8 and #9, even though marginal, are still useful in substantially preventing separation of nonionics.

The following examples, without limiting the scope thereof, will more fully illustrate the embodiments of this invention. All parts, percentages and proportions referred to herein and in the appended claims are by weight unless otherwise indicated.

In each case, in the slurry stage, sufficient water is utilized so that the slurry contains about 65% solids. However, if desired, the solid content in the slurry may range from about 55% to about 75%. After observing that there is no tendency for the nonionic to separate, the slurry is spray-dried to obtain a product with the finished analysis as shown in the tables below. Although spray-drying of the slurry is a preferred method of preparing finished composition, alternative methods of drying including heated mechanical mixers and other devices or processes well known to those skilled in the art may also be used.

EXAMPLE I

A typical detergent slurry is prepared by mixing the various components in the order as shown in Table 2. A control slurry is obtained by omitting the iminodipropionate from the composition.

TABLE 2

| Component | % Active Basis Finished Product |
|---|---|
| Water (130° F.) | 9.3 |
| Primary alcohol ethoxylate (Neodol 45-13) | 8.9 |
| Disodium N—branched tridecyloxypropyl-iminodipropionate | 0.1 |
| Na carboxymethylcellulose | 0.2 |
| Optical brightners | 0.1 |
| Sodium tripolyphosphate | 30.0 |
| Sodium silicate (2.4 ratio) | 4.5 |
| Borax ($Na_2B_4O_7.10H_2O$) | 1.0 |
| Sodium coconut soap | 1.0 |
| Sodium sulfate | Balance to 100% |

It should be noted that when the slurry is prepared without the addition of the iminodipropionate, a separation of the nonionic, as tested by the method described herein supra, readily occurs. When the iminodipropionate is included in the composition no such separation is observed.

EXAMPLE II

The preparation of a non-phosphate slurry mixture using citrate-carbonate base is shown in Table 3. It should be noted that the use of a high level of the nonionic, viz, up to about 20% by weight of the final composition, without separation of the nonionic is illustrated in this embodiment of the invention.

TABLE 3

| Components | Final Formulation % Active |
|---|---|
| Water | 6.5 |
| Primary alcohol ethoxylate (Neodol 25-9) | 19.5 |
| EMA-21 (ethylene maleic anhydride copolymer) | 0.3 |
| Disodium N—branched tridecyloxypropyl-iminodipropionate | 0.2 |
| Brightners | 0.4 |
| Sodium carboxymethylcellulose | 0.3 |
| Sodium carbonate | 52.0 |
| Sodium silicate (2.4 ratio) | 4.4 |
| Sodium citrate | 16.4 |
| | 100.0 |

EXAMPLE III

A detergent slurry was prepared as in Example I, except that the nonionic (primary alcohol ethoxylate, Neodol 45-13) and the iminodipropionate in Example I were replaced by an equivalent amount of a polyethylene glycol ether of a secondary alcohol (Tergitol 15-S9) and compound number 1 of Table 1, respectively. No separation of the nonionic was observed in the slurry of this composition.

EXAMPLE IV

A detergent slurry was prepared as in Example I, except that the level of sodium tripolyphosphate was reduced from 30% to about 15% and the reduced amount of the tripolyphosphate was replaced with an equal amount (15%) of sodium aluminosilicate (Zeolite). The iminodipropionate of Example I was also replaced with an equivalent amount of compound number 1 of Table 1. The slurry formulation showed no separation of the nonionic.

It is understood that the examples and embodiments described herein are for illustrative purposes only and that various modifications or changes in the light thereof will be suggested to persons skilled in the art and are to be included within the spirit and purview of this application and the scope of the appended claims.

What is claimed is:

1. An aqueous detergent slurry composition having a solids content of about 55 to about 75% by weight consisting essentially of:
   (a) about 10%–60% builder;
   (b) about 2%–25% nonionic surfactant;
   (c) 0% to about 30% other ingredients;
   (d) an effective amount to substantially prevent separation of the nonionic from the detergent composition of a surface active iminodipropionate of the general formula:

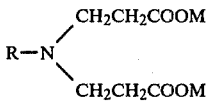

wherein R is an alkyl, hydroxyalkyl or alkoxyalkyl group containing from about 10 to about 18 carbon atoms and M is an alkali metal cation; and
   (e) the remainder water whereby said nonionic does not undergo substantial separation from said composition.

2. A detergent composition according to claim 1 wherein said builder is selected from the group consisting of alkali metal phosphates, carbonates, citrates, silicates, nitrilotriacetates, carboxymethyloxysuccinates, zeolites and mixtures thereof.

3. A detergent composition according to claim 1 wherein said nonionic surfactant is selected from the group consisting of primary alcohol ethoxylates, secondary alcohol ethoxylates, alkyl phenol ethoxylates, and mixtures thereof.

4. A detergent composition according to claim 1 wherein said other ingredient is selected from one or more of the following: soaps, suds stabilizers, coloring dyes, organic solvents, fluorescent dyes, co-surfactants, carboxymethylcellulose, enzymes, neturalized copolymers of ethylene and maleic anhydrides and perfumes.

5. A detergent composition according to claim 1 wherein said surface active iminodipropionate is selected from the group consisting of alkali metal salts of N-alkyl iminodipropionic acid, N-alkoxyalkyl iminodipropionic acid and mixtures thereof, wherein said alkyl and said alkoxyalkyl groups contain about 10 to 18 carbon atoms.

6. A detergent composition according to claim 4 wherein said co-surfactant is selected from the group consisting of anionic, catonic, zwitterionic surfactants and mixtures thereof.

7. A detergent composition according to claim 5 wherein said R is a n-$C_{12}H_{25}$ moiety.

8. A detergent composition according to claim 5 wherein said R is a n-$C_{14}H_{29}$ moiety.

9. A detergent composition according to claim 1 wherein the amount of said surface active iminodipropionate is about 0.5%.

10. A detergent composition according to claim 1 wherein the amount of said surface active iminodipropionate is about 0.1%.

* * * * *